US007240514B2

(12) United States Patent
Gary

(10) Patent No.: US 7,240,514 B2
(45) Date of Patent: Jul. 10, 2007

(54) REDUCED VOLUME CARRIER FOR CANNED OR BOTTLED BEVERAGES

(76) Inventor: Lonnie F. Gary, 68 E. Lakeshore Dr., Ransom Canyon, TX (US) 79366

( * ) Notice: Subject to any disclaimer, the term of this patent is extended or adjusted under 35 U.S.C. 154(b) by 0 days.

(21) Appl. No.: 11/091,091

(22) Filed: Mar. 28, 2005

(65) Prior Publication Data

US 2006/0213217 A1 Sep. 28, 2006

(51) Int. Cl.
*F25D 3/08* (2006.01)

(52) U.S. Cl. ..... 62/457.5; 62/530

(58) Field of Classification Search ..... 62/457.1, 62/457.2, 457.3, 457.4, 457.5, 530, 371
See application file for complete search history.

(56) References Cited

U.S. PATENT DOCUMENTS 3,401,535 A * 9/1968 Palmer ..... 62/457.5

4,438,637 A * 3/1984 Atkinson ..... 62/457.5

* cited by examiner

*Primary Examiner*—Melvin Jones
(74) *Attorney, Agent, or Firm*—Locke Liddell & Sapp, LLP

(57) ABSTRACT

A carrier having a body with arcuate sidewall sections and an integrally formed base, the body being sufficiently rigid to support a plurality of individual canned or bottled beverages. The carrier also includes an internal coolant chamber, a durable handle, and an elastomeric, thermally insulative band that is releasably securable around the body to maintain the beverages in supported contact with the body until removed for consumption of the contained beverage. Upon removal of all beverage containers from the carrier, the band desirably contracts into engagement with the projecting portions of the body perimeter to reduce the overall volume defined by the carrier. Shoulders are preferably provided on the body of the carrier to assist in maintaining the elastomeric band in a preferred positional alignment relative to the body.

11 Claims, 4 Drawing Sheets

REDUCED VOLUME CARRIER FOR CANNED OR BOTTLED BEVERAGES

BACKGROUND OF THE INVENTION

1. Field of the Invention

This invention relates to carriers for canned or bottled beverages, and more particularly, to a pre-cooled carrier for a six-pack of chilled beverages that collapses to a reduced volume after the beverage containers are removed.

2. Description of Related Art

Six-pack sized insulated carriers for canned or bottled beverages are well known, and are also available with molded plastic inserts holding a liquid cooling agent that can be frozen or refrigerated prior to use. A disadvantage of such devices is that they are bulky and do not collapse to a reduced size after the beverages are consumed and the disposable containers are discarded.

Other six-pack or twelve-pack carriers are available for canned or bottled drinks, which carriers are not insulated or lack a liquid reservoir that can be pre-cooled to assist in keeping the beverages cool prior to consumption.

SUMMARY OF THE INVENTION

According to a preferred embodiment of the invention, the subject beverage carrier includes a body having arcuate sidewall sections and an integrally formed base that are sufficiently rigid to support a plurality of individual canned or bottled beverages. The body also includes an internal coolant chamber with a coverable fill port through which the coolant chamber is filled with coolant. A durable plastic carrying handle no wider than the body is also provided, most preferably unitarily molded together with the body, and an elastomeric, thermally insulative band that is releasably securable around the body to maintain the beverages in supported contact with the body until removed for consumption of the contained beverage. Upon removal of all beverage containers from the carrier, the band desirably contracts into engagement with the projecting portions of the body perimeter to reduce the overall volume defined by the carrier. Shoulders are preferably provided on the body of the carrier to assist in maintaining the elastomeric band in a preferred positional alignment relative to the body during use and subsequent storage.

BRIEF DESCRIPTION OF THE DRAWINGS

The apparatus of the invention is further described and explained in relation to the following drawings wherein.

DESCRIPTION OF THE PREFERRED EMBODIMENTS

Figure 8:
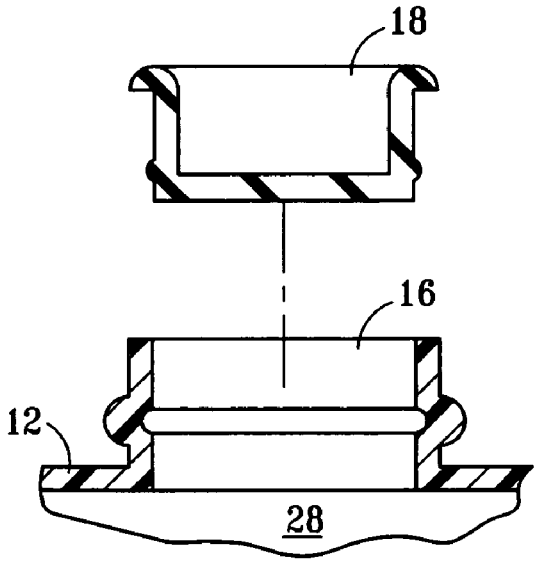
FIG. 8 is an enlarged cross-sectional front elevation view, partially broken away, of the coolant fill port and closure of FIG. 5.
Figure 10:
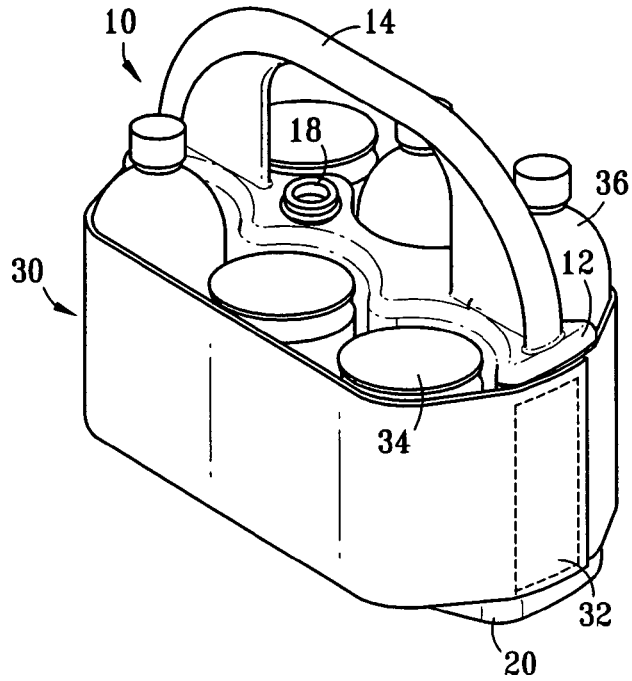
FIG. 10 is a top perspective view of the beverage carrier of FIG. 1 with the elastomeric band in place around the carrier and with six canned or bottled beverage containers supported on the carrier and releasably secured to the carrier by the band.

Referring to the preferred embodiment of the invention shown in FIGS. 1–7, beverage carrier 10 comprises body 12, handle 14 and base 20. Body 12, handle 14 and base 20 are most preferably, but not necessarily, injection molded as a unitary article from a polymeric material such as high density polyethylene. Body 12 preferably comprises opposed sidewall sections, with two of said sidewall sections further comprising a plurality of arcuate recesses 22, each arcuate recess 22 being dimensioned to receive and generally conform to the outside curvature of a beverage can or bottle. Base 20 is most preferably generally elliptically shaped and provides bottom support to beverage containers nested against arcuate recessed sidewall sections 22 as depicted in FIG. 10. Fill port 16 in body 12 preferably communicates with internal coolant chamber 28 disposed inside body 12 and base 20. Referring to the detail view shown in FIG. 8, cover 18 is preferably removable and frictionally enagageable with fill port 16, and is desirably provided for sealing inside body 12 a liquid coolant introduced through fill port 16. It will be appreciated that other similarly effective conventional closures can likewise be used in combination with fill port 16. Referring to FIGS. 1–5 and 7, handle 14, like body 12 and base 20, is preferably hollow, but can be provided with solid or hollow reinforcing members 24 to provide additional strength and durability to carrier 10.

Figure 9:
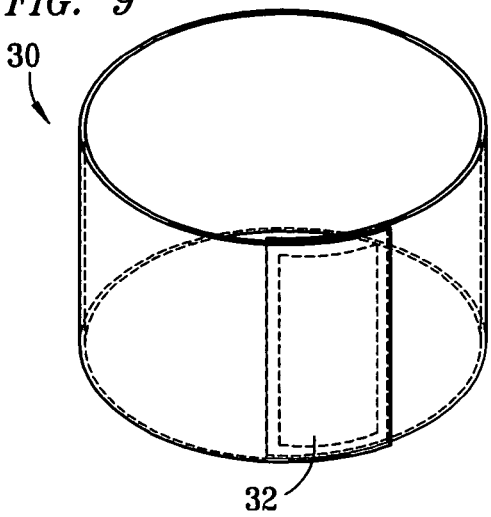
FIG. 9 is a top perspective view of a preferred embodiment of the elastomeric band for use with the carrier as shown in FIG. 1.
Figure 11:
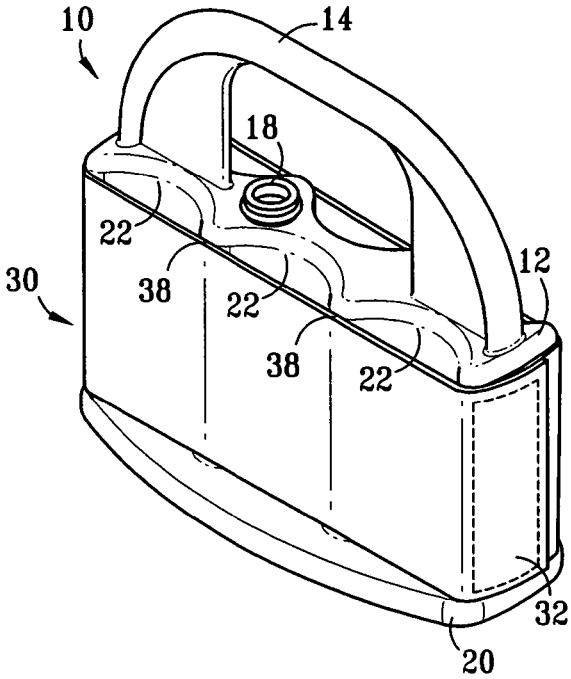
FIG. 11 is a top perspective view of the beverage carrier of FIG. 10 with the six beverage containers removed and the elastomeric band contracted into a reduced-volume position around the carrier body for storage pending subsequent use.

Referring to FIGS. 9–11, an elastic, elastomeric or expandable band 30 is desirably provided for use in releasably securing a plurality of individual drink containers such as cans 34 and bottles 36 against sidewall recesses 22 of body 12, while bottom support is also provided by base 20. It should be noted that in the most preferred embodiment, base 20 desirably does not extend laterally from body 12 a sufficient distance to provide contacting bottom support to the entire perimeter of the bottom of each container, thereby reducing the overall width of carrier 10 when the containers are removed as shown in FIG. 11. Base 20 is desirably sufficiently rigid and durable that containers 34, 36 can be supported in carrier 10 where base 20 spans and contacts only a portion of the container bottoms. However, it will be appreciated upon reading this disclosure that base 20 can be made so as to extend a greater distance laterally if, for example, one desires to provide direct contact with a greater portion of the container bottoms to provide greater support or to further deter warming of the beverages.

Figure 1:
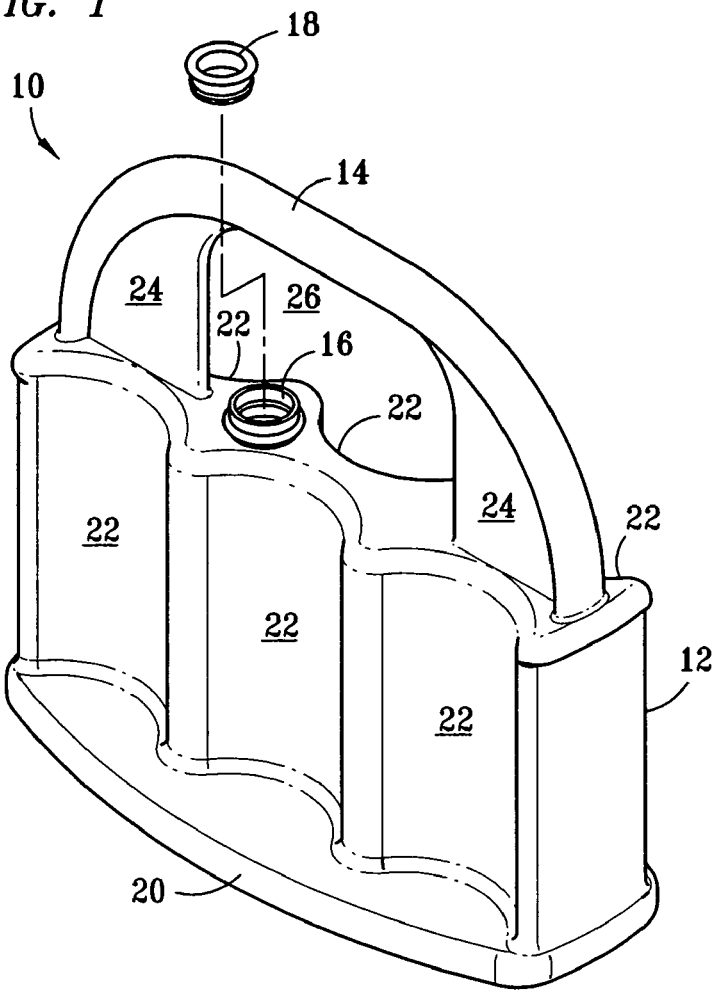
FIG. 1 is a top perspective view of a preferred embodiment of the beverage carrier of the invention with the elastomeric band removed to better depict the body of the carrier.
Figure 2:
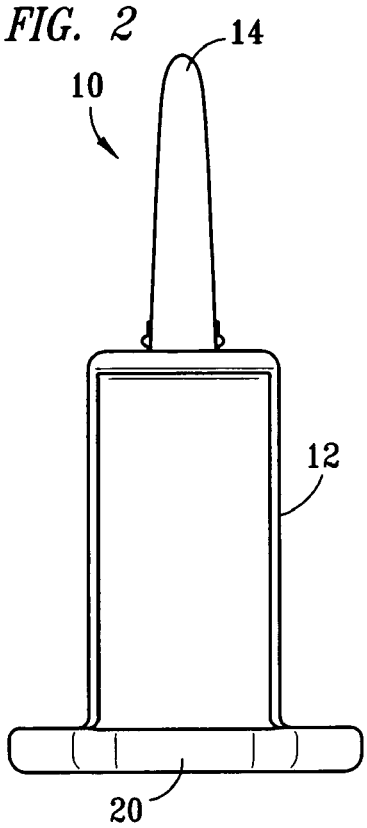
FIG. 2 is a side elevation view of the carrier of FIG. 1.
Figure 3:
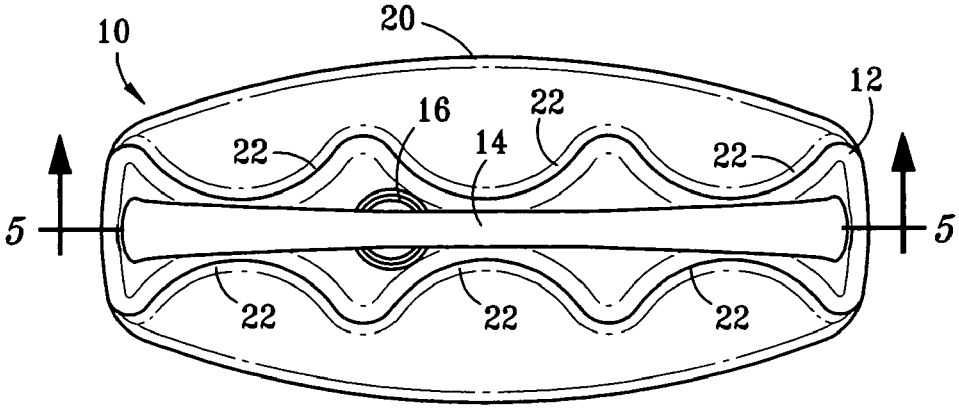
FIG. 3 is a top plan view of the carrier of FIG. 1.
Figure 4:
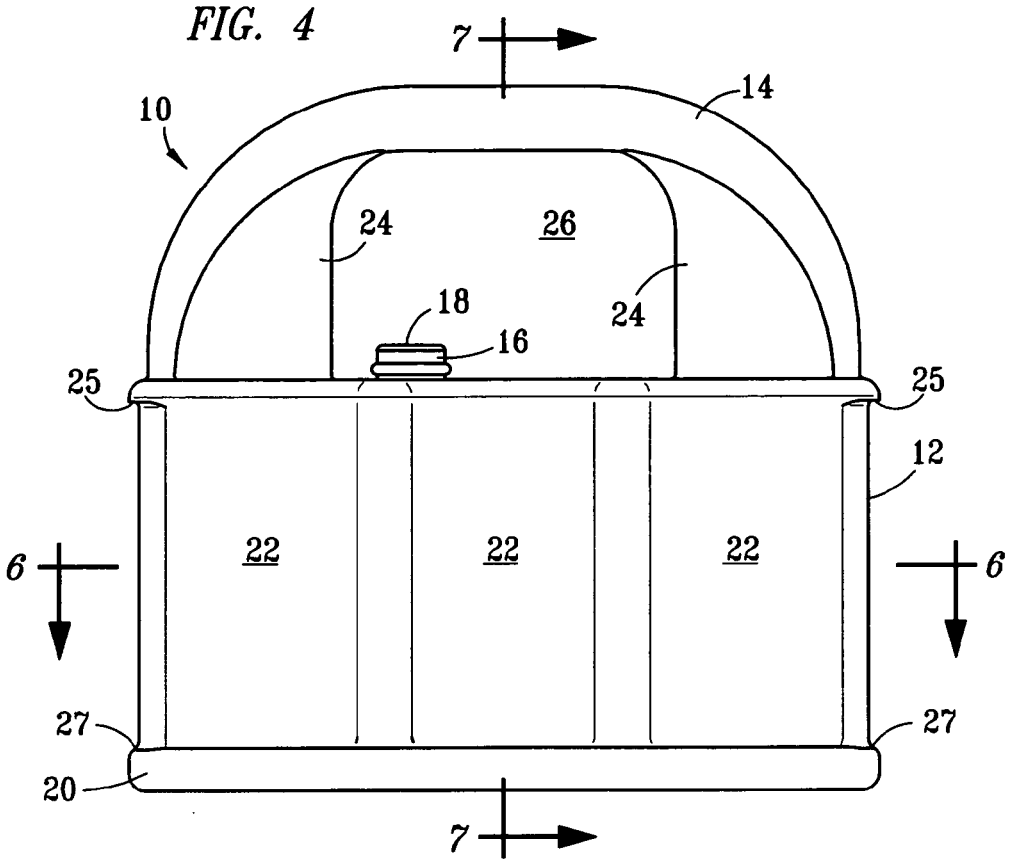
FIG. 4 is a front elevation view of the carrier of FIG. 1.
Figure 5:
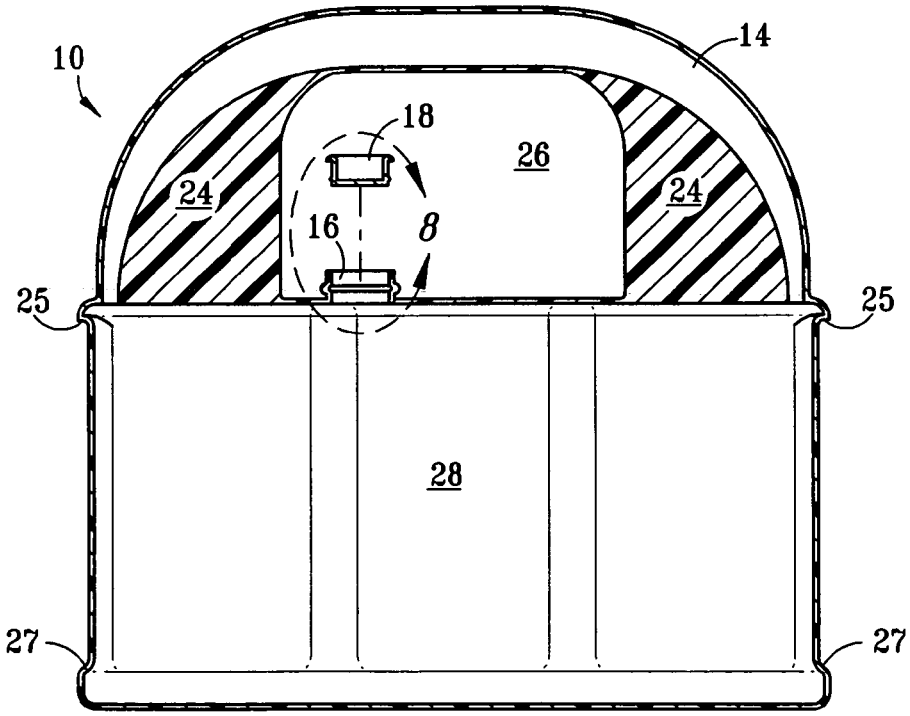
FIG. 5 is a cross-sectional front elevation view taken along line 5—5 of FIG. 3.
Figure 6:
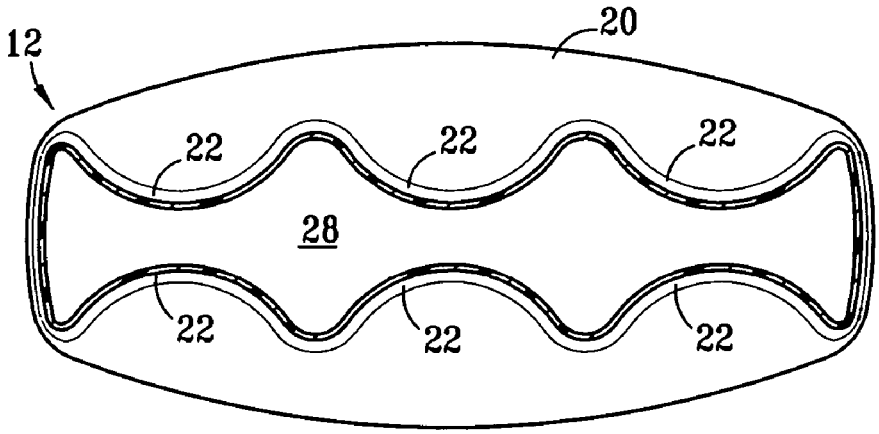
FIG. 6 is a cross-sectional plan view taken along line 6—6 of FIG. 4.
Figure 7:
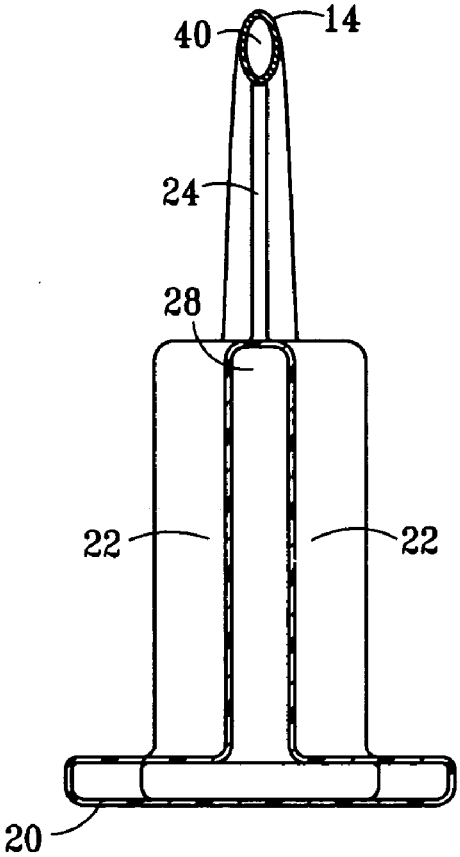
FIG. 7 is a cross-sectional side elevation view taken along line 7—7 of FIG. 4.

Band 30 is preferably made of a foamed elastomeric material such as neoprene foam, and can be made, for example, by securing or connecting the two ends of a strip of the material as illustrated in the drawings, wherein the ends of the strip are overlapped and sewn to form closure 32. It will be appreciated upon reading this disclosure that other similarly effective, commercially available closure means can likewise be used to form band 30. Band 30 is most preferably made of neoprene foam having a thickness of about 3 mm and a band diameter of about 6 inches after the ends are sewn as shown in FIG. 9. A nylon covering material is preferably bonded to the inner and outer surfaces of band 30 to make band 30 more durable and reduce wear or degradation to the elastomeric foam during use. Referring to FIGS. 4 and 5, upper and lower shoulders 25, 27, respectively are preferably provided to help hold band 30 in position relative to body 12 and base 20 of beverage carrier 10. The vertical spacing between shoulders 25, 27 is desirably slightly greater than the height of band 30.

Prior to use, inside chamber 28 of beverage carrier 10 is preferably filled to a predetermined level with water or another suitable liquid, and is then chilled or frozen. This can be done at home and removed from a freezer immediately prior to use if, for example, carrier 10 is going to be used to keep beverages cool on a backyard patio. Where the beverages are going to be consumed away from home, the user may want to drop the pre-frozen carrier into an ice chest prior to filling it with beverages. The canned or bottled beverages carried to be used in carrier 10 are also desirably pre-cooled or chilled prior to use with carrier 10.

Beverage carrier 10 is particularly useful where, for example, it is desirable to transport a plurality of chilled beverages that are intended to be consumed within a reasonably short interval but at a location where an ice chest or conventional insulated cooler would be too bulky or otherwise inconvenient. Thus, one might transport an ice chest containing a case or two of canned or bottled beverages to a picnic or camp site and then use beverage carrier 10 of the invention to take a six-pack of beverages out onto a boat, fishing dock, swimming raft, or the like. Similarly, one might transport an ice chest full of beverages to a sporting event in a vehicle and then fill beverage carrier 10 to transport a six-pack of beverages from the parking lot onto the event grounds without having to transport the bulkier and heavier ice chest. Beverage carrier 10 is not intended to chill canned or bottled beverages from ambient outdoor temperatures to preferred drinking temperatures, but is helpful for maintaining pre-cooled beverages within a temperature range suitable for consumption for a longer period.

FIG. 10 depicts three beverage cans 34 and three beverage bottles 36 being supported by bottom 20 of carrier 10 and being held in contact with arcuate recesses 22 of chilled body 12 by elastomeric band 30. FIG. 11 depicts carrier 10 after beverage cans 34 and bottles 36 shown in FIG. 10 have been removed and their contents presumably consumed. If desired, each can 34 or bottle 36 can be reinserted into carrier 10 following consumption of its contents, or they can be discarded in an acceptable manner and carrier 10 can be stored or returned for reuse in the configuration shown in FIG. 11. Referring to FIG. 11, it will be observed that elastomeric band 30 has contracted into a snug contacting relationship with body 12, with portions of band 30 contacting projecting surface members 38 disposed between adjacent arcuate recesses 22 of body 12.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventors are legally entitled.

I claim:

1. A drink carrier comprising:

a body having sidewalls with recessed arcuate sections, an internal cooling chamber and an integrally formed base that are sufficiently rigid to support a plurality of individual canned or bottled beverages;

a durable plastic carrying handle no wider than the body; and an elastomeric band that is releasably securable around the body to maintain the beverages in supported contact with the body until removed from the carrier.

2. The drink carrier of claim 1 wherein the body further comprises a fill port through which a liquid coolant can be introduced into the internal cooling chamber.

3. The drink carrier of claim 2, further comprising a removable cover for the fill port.

4. The drink carrier of claim 3 wherein the fill port and cover are frictionally engageable.

5. The drink carrier of claim 1 comprising six recessed arcuate sidewall sections, each arcuate sidewall section substantially conforming to a sidewall configuration of a beverage can or bottle.

6. The drink carrier of claim 1 wherein the body further comprises a purality of shoulders useful in positioning the band relative to the body.

7. The drink carrier of claim 1 wherein the band is contractable into engagement with a plurality of projections disposed around the body.

8. The drink carrier of claim 1 wherein the band is substantially circular, is formed from a strip, and is made of neoprene foam.

9. The drink carrier of claim 8 wherein the band has a thickness of about 3 mm.

10. The drink carrier of claim 8 wherein the substantially circular band has an unexpanded diameter of about six inches.

11. The drink carrier of claim 8 wherein the neoprene foam has a nylon backing.

* * * * *